US008671636B2

(12) United States Patent
Bruner

(10) Patent No.: US 8,671,636 B2
(45) Date of Patent: Mar. 18, 2014

(54) STUD FRAME WALL SYSTEM

(76) Inventor: Walter Kim Bruner, Niles, MI (US)

( * ) Notice: Subject to any disclaimer, the term of this patent is extended or adjusted under 35 U.S.C. 154(b) by 0 days.

(21) Appl. No.: 13/493,855

(22) Filed: Jun. 11, 2012

(65) Prior Publication Data

US 2013/0326977 A1 Dec. 12, 2013

(51) Int. Cl.

| | |
|---|---|
| ***E04B 1/00*** | (2006.01) |
| ***E04B 5/00*** | (2006.01) |
| ***E04B 7/00*** | (2006.01) |
| ***E04B 1/26*** | (2006.01) |
| ***E04B 2/56*** | (2006.01) |
| ***E04B 2/70*** | (2006.01) |

(52) U.S. Cl.
CPC ... *E04B 1/26* (2013.01); *E04B 2/56* (2013.01); *E04B 2/706* (2013.01)
USPC ..... 52/274

(58) Field of Classification Search
CPC ..... E04B 1/26; E04B 1/18; E04B 1/02; E04B 1/10; E04B 2001/2684; E04B 2/56; E04B 2/706; E04B 2/707
USPC ..... 52/274, 474, 481.1, 693, 694, 93.1, 52/293.3
See application file for complete search history.

(56) References Cited

U.S. PATENT DOCUMENTS

| | | | | |
|---|---|---|---|---|
| 2,539,279 | A | 1/1951 | Shannon et al. | |
| 3,305,993 | A * | 2/1967 | Nelsson | 52/481.1 |
| 3,465,488 | A * | 9/1969 | Miller | 52/481.1 |
| 3,488,904 | A * | 1/1970 | Dawdy et al. | 52/241 |
| 3,495,417 | A * | 2/1970 | Ratliff, Jr. | 52/168 |
| 3,501,885 | A * | 3/1970 | Stewart | 52/410 |
| 3,623,288 | A * | 11/1971 | Horowitz | 52/264 |
| 3,975,876 | A | 8/1976 | Sauder | |
| 3,999,343 | A * | 12/1976 | Roberts | 52/241 |
| 4,161,087 | A | 7/1979 | Levesque | |
| 4,161,089 | A * | 7/1979 | Omansky | 52/223.7 |
| 4,224,774 | A * | 9/1980 | Petersen | 52/404.1 |
| 4,235,054 | A | 11/1980 | Cable et al. | |
| 4,281,491 | A * | 8/1981 | Schonert | 52/281 |
| 4,330,971 | A | 5/1982 | Auberger | |
| 4,435,929 | A | 3/1984 | Bussell | |
| 4,656,792 | A | 4/1987 | Clark | |

(Continued)

OTHER PUBLICATIONS

Robert Riversong, A Cost Effective Larson Truss Design, http://www.builditsolar.com/Projects/SolarHomes/LarsenTruss/LarsenTruss.htm.

(Continued)

*Primary Examiner* — Mark Wendell
*Assistant Examiner* — Keith Minter
(74) *Attorney, Agent, or Firm* — Brian M. Holt

(57) ABSTRACT

A wall is provided with a plurality of stud frames disposed in at least one row, an outer layer, an inner layer, and an insulation layer. The stud frames are coupled between the outer layer and the inner layer. The stud frames are provided with a front stud, a back stud, a top plate, a bottom plate and at least one support member. The support members are coupled with the front stud and the back stud. The front stud and the back stud are disposed vertically. The broad sides of the front stud are parallel with the broad sides of the back stud. The top plate and the bottom plate are disposed horizontally. The top member is coupled with a top end of the front stud and a top end of the back stud. The bottom plate is coupled between the front stud and the back stud.

20 Claims, 8 Drawing Sheets

(56) References Cited

U.S. PATENT DOCUMENTS

| | | | | |
|---|---|---|---|---|
| 4,674,253 | A * | 6/1987 | Young | 52/404.2 |
| 4,813,193 | A * | 3/1989 | Altizer | 52/210 |
| 4,854,096 | A | 8/1989 | Smolik | |
| 4,887,406 | A | 12/1989 | Saia | |
| 5,297,369 | A * | 3/1994 | Dickinson | 52/281 |
| 5,535,556 | A * | 7/1996 | Hughes, Jr. | 52/169.5 |
| 5,609,006 | A | 3/1997 | Boyer | |
| 5,617,693 | A | 4/1997 | Hefner | |
| 5,706,626 | A * | 1/1998 | Mueller | 52/800.12 |
| 5,765,330 | A * | 6/1998 | Richard | 52/309.13 |
| 5,953,883 | A * | 9/1999 | Ojala | 52/794.1 |
| 5,987,841 | A * | 11/1999 | Campo | 52/648.1 |
| 6,209,282 | B1 * | 4/2001 | Lafrance | 52/841 |
| 6,219,975 | B1 * | 4/2001 | Olden | 52/92.2 |
| 6,244,004 | B1 * | 6/2001 | Timmerman et al. | 52/274 |
| 6,279,284 | B1 * | 8/2001 | Moras | 52/408 |
| 6,412,249 | B1 | 7/2002 | Boyer et al. | |
| 6,481,172 | B1 * | 11/2002 | Porter | 52/506.01 |
| 6,701,684 | B2 * | 3/2004 | Stadter | 52/309.7 |
| 6,772,572 | B2 | 8/2004 | Henthorn | |
| 6,854,230 | B2 * | 2/2005 | Starke | 52/481.1 |
| 6,857,237 | B1 * | 2/2005 | Dalphond et al. | 52/309.7 |
| 6,931,804 | B2 * | 8/2005 | Trarup et al. | 52/295 |
| 6,976,345 | B2 * | 12/2005 | Keshmiri | 52/745.05 |
| 7,032,356 | B2 * | 4/2006 | Layfield | 52/407.1 |
| 7,127,856 | B2 | 10/2006 | Hagen, Jr. et al. | |
| 7,168,216 | B2 * | 1/2007 | Hagen, Jr. | 52/480 |
| 7,409,800 | B2 | 8/2008 | Budge | |
| 7,506,479 | B2 * | 3/2009 | Pryor | 52/293.3 |
| 7,634,888 | B2 | 12/2009 | Cloyd et al. | |
| 7,690,167 | B2 * | 4/2010 | Antonic | 52/481.1 |
| 7,797,907 | B2 * | 9/2010 | Timmerman et al. | 52/800.12 |
| 7,946,384 | B2 * | 5/2011 | Foster et al. | 181/290 |
| 8,109,058 | B2 * | 2/2012 | Miller | 52/309.7 |
| 8,112,968 | B1 * | 2/2012 | Mueller | 52/800.12 |
| 8,136,318 | B2 * | 3/2012 | Espinosa | 52/293.3 |
| 2001/0002529 | A1 * | 6/2001 | Commins et al. | 52/481.1 |
| 2002/0002806 | A1 * | 1/2002 | Commins et al. | 52/481.1 |
| 2002/0046514 | A1 * | 4/2002 | Leung | 52/167.3 |
| 2006/0143998 | A1 * | 7/2006 | Timmerman et al. | 52/293.3 |
| 2007/0130865 | A1 * | 6/2007 | Nusz et al. | 52/481.1 |
| 2007/0130866 | A1 * | 6/2007 | Lott | 52/481.1 |
| 2008/0083180 | A1 * | 4/2008 | Miller | 52/309.4 |
| 2011/0005163 | A1 * | 1/2011 | Timmerman et al. | 52/653.1 |
| 2011/0265412 | A1 | 11/2011 | Sharpe et al. | |
| 2013/0025222 | A1 * | 1/2013 | Mueller | 52/293.3 |

OTHER PUBLICATIONS

John Straube and Jonathan Smegal, Building America Special Research Project: High R Walls Case Study Analysis, Jun. 8, 2011, Building Science Corporation, Building Science Press, Somerville, MA, USA.

* cited by examiner

STUD FRAME WALL SYSTEM

BACKGROUND

1. Field of the Invention

This invention relates to a stud frame wall system. More particularly, the invention relates to a stud frame and a superinsulated wall comprising a plurality of stud frames.

2. Description of Related Art

There is a need, increasingly apparent, for buildings that are environmentally friendly and energy efficient. In cooler climates, this means, among other things, buildings with a high degree of thermal retention. A solution has been to construct buildings with thicker walls and roofs, capable of enclosing increased amounts of insulation. There is also a need, ever present, to reduce the cost of construction. One solution has been to construct buildings, at least in part, from prefabricated sections.

In their research report, Building America Special Research Project: High-R Walls Case Study Analysis, John Straube and Jonathan Smegal show a truss wall, with a wide inner wall space for insulation, provided with a plurality of truss frames. The truss frames are provided with a front stud and a back stud coupled by three rectangular gussets. A narrow-side of the front stud is parallel with a narrow-side of the back stud. Moreover, the front stud and the back stud are shown to have different dimensions.

An alternative solution, with a wide inner wall space for insulation, is provided by U.S. Pat. No. 6,926,141, issued on Aug. 9, 2005 (Hefner). Hefner discloses a prefabricated truss frame for a truss frame wall. The truss frame is provided with a front stud and a back stud with different widths. The truss frame is further provided with spacers and diagonal cross braces coupled with the front stud and the back stud. In particular, the truss frame is provided with an upper spacer between the front stud and the back stud. The truss frame is also provided with metal truss plates coupling various joints. For coupling the truss frames with a foundation, each of the truss frames is provided with a box sill.

Therefore, it is an object of the invention to provide a stud frame wall system that overcomes deficiencies in the prior art.

DETAILED DESCRIPTION

Figure 1:
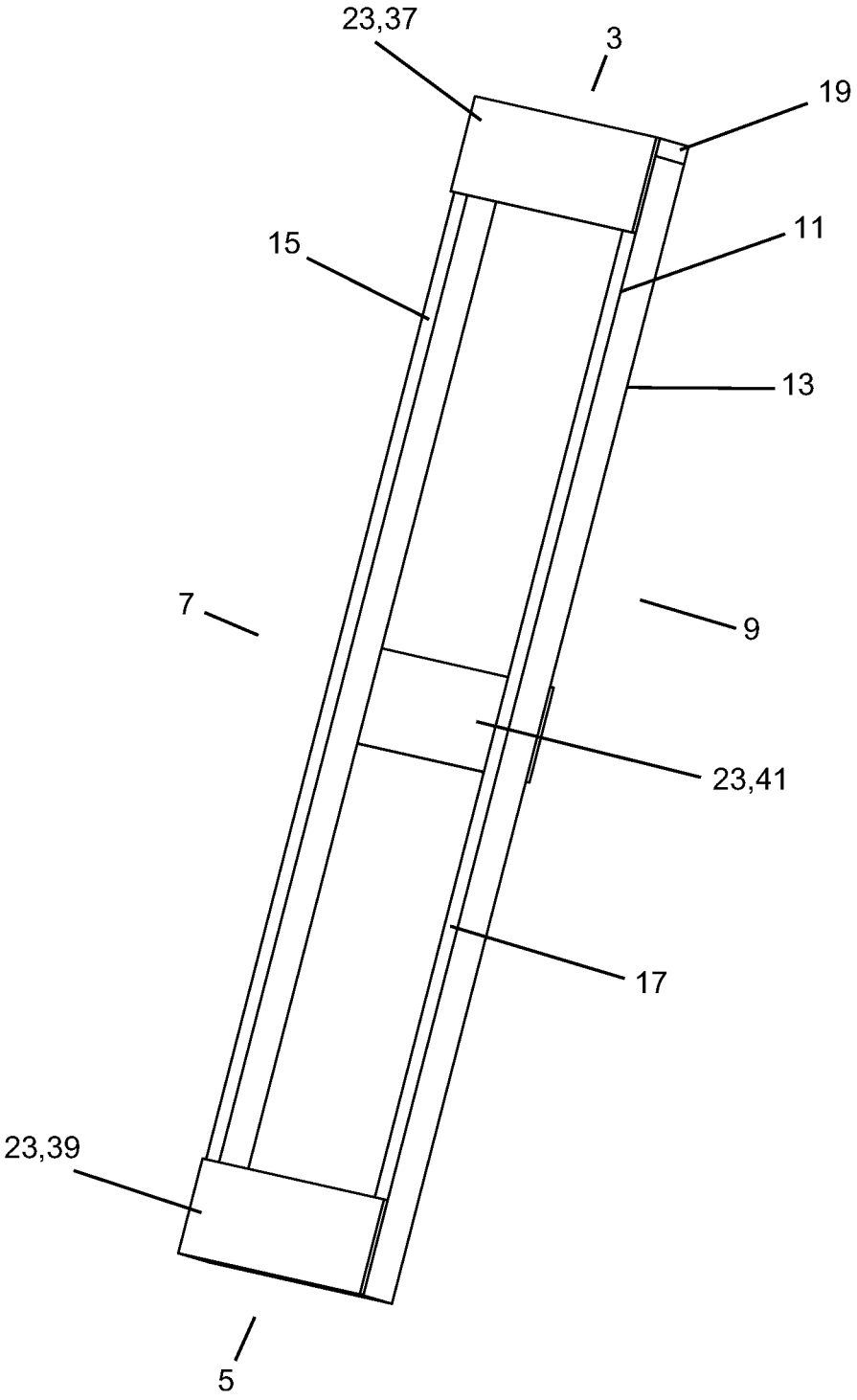
FIG. 1 is a schematic isometric angled first side view of an exemplary stud frame.
Figure 2:
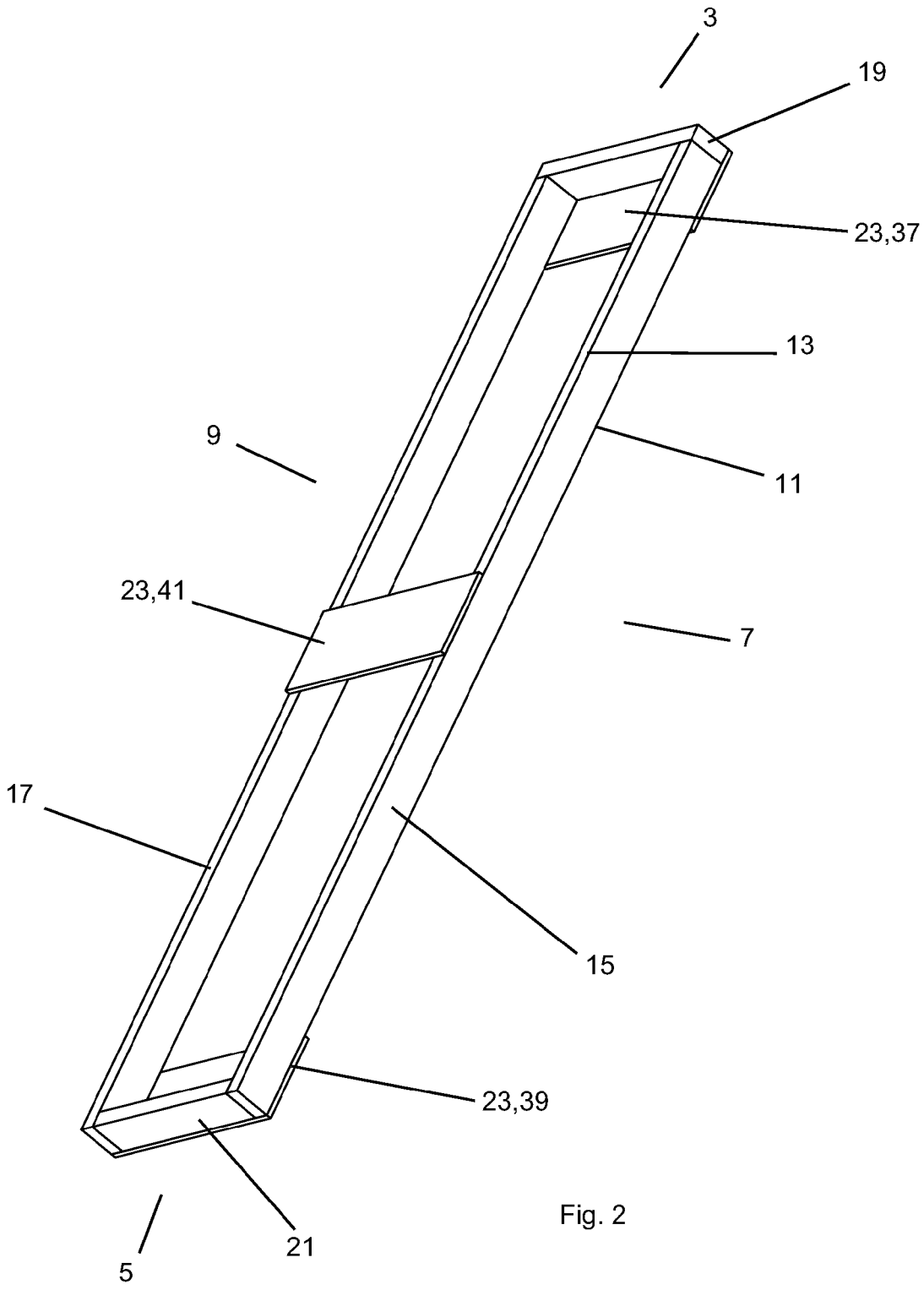
FIG. 2 is a schematic isometric angled second side view of FIG. 1.

The inventor has recognized that a wall for sides of a superinsulated building, with a wide inner wall space for insulation, may be constructed more strongly, with less labor involved, and with less expense, than is now conventional. The inventor has further recognized that prefabricated stud frames for superinsulated walls may be constructed which have fewer parts, and provide easier on-site installation, than is now typical.

An exemplary embodiment of a stud frame 1 for walls of a building with a roof and a foundation is demonstrated in FIGS. 1-9, and best shown in FIGS. 1-5. The stud frame 1 is provided with a top side 3, a bottom side 5, an outer side 7, an inner side 9, a first side 11 and a second side 13. One skilled in the art will appreciate that the top side 3, the bottom side 5, the outer side 7, the inner side 9, the first side 11 and the second side 13 are applied herein as identifiers for respective sides of both the stud frame 1 and the discrete elements of the stud frame 1 to identify the same and their respective interconnecting surfaces according to their alignment. One skilled in the art will also appreciate that the first side 11 and the second side 13, while mutually exclusive, are interchangeable and imply no particular orientation, which is to say, for example, both the first side 11 and the second side 13 may be either a left side or a right side of the stud frame 1.

As best shown in FIGS. 1-5, an exemplary embodiment of the stud frame 1 is provided with a front stud 15, a back stud 17, a top plate 19 and a bottom plate 21. At least one support member 23 is coupled with the front stud 15 and the back stud 17. The front stud 15 and the back stud 17 are each disposed vertically. The front stud 15 and the back stud 17 may be substantially equal in length and width. An outer side 7 and an inner side 9 of the front stud 15 and the back stud 17 may be broad sides, which is to say, the outer side 7 and the inner side 9 of the front stud 15 and the back stud 17 may be wider than a first side 11 and a second side 13 of the front stud 15 and the back stud 17. The outer side 7 and the inner side 9 of the front stud 15 may be parallel with the outer side 7 and the inner side 9 of the back stud 17.

The top plate 19 and the bottom plate 21 are each disposed horizontally. The top plate 19 and the bottom plate 21 may be substantially equal in width to the front stud 15 and the back stud 17. A top side 3 and a bottom side 5 of the top plate 19 and the bottom plate 21 may be wider than a first side 11 and a second side 13 of the top plate 19 and the bottom plate 21. The top side 3 and the bottom side 5 of the top plate 19 may be parallel with the top side 3 and the bottom side 5 of the bottom plate 21. The bottom side 5 of the top plate 19 may be coupled with a top side 3 of the front stud 15 and a top side 3 of the back stud 17. Positioning a broad side of the top plate 21 on top of the top side 3 of the front stud 15 and the top side 3 of the back stud 17, allows a load to be borne equally by the front stud 15 and the back stud 17. An outer side 7 of the top plate 19 may be flush with the outer side 7 of the front stud 15, and an inner side 9 of the top plate 19 may be flush with the inner side 9 of the back stud 17.

The bottom plate 21 may be coupled between the front stud 15 and the back stud 17. The bottom side 5 of the bottom plate 21 may be flush with a bottom side 5 of the front stud 15 and a bottom side 5 of the back stud 17.

The top plate 19 may be coupled with the front stud 15 and the back stud 17 via, for example, a plurality of fasteners, such as screws or nails. Similarly, the bottom plate 21 may be coupled with the front stud 15 and the back stud 17 via, for example, a plurality of fasteners, such as screws or nails.

The front stud 15, the back stud 17, the top plate 19, and the bottom plate 21 may each be a standard nominal two inches thick by four inches wide board (substantially 1½ inches by 3½ inches). Standard nominal two inches thick by four inches wide board has the advantages of being widely available, sufficiently strong for wall construction, and cost effective when compared with alternatives. Additionally, the front stud 15 and the back stud 19 may each be a standard nominal eight feet long (substantially 96 inches). The top plate 19 may be substantially twenty-one inches long; correspondingly, the bottom plate 21 may be substantially eighteen inches long, resulting in a stud frame 1 with a width of twenty-one inches.

Figure 3:
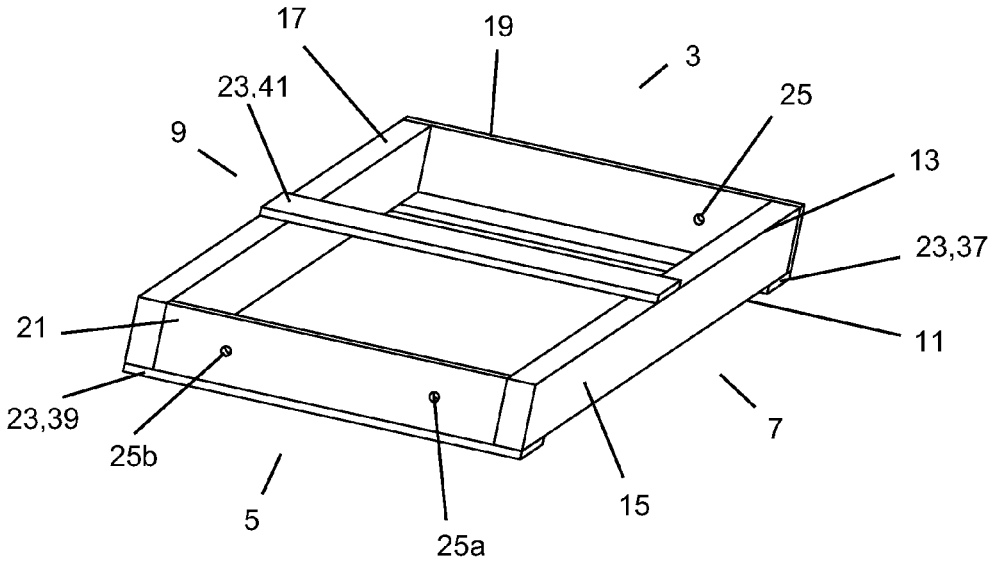
FIG. 3 is a schematic isometric angled bottom side view of FIG. 1 with the bottom plate provided with two apertures and the top plate provided with a single aperture.
Figure 5:
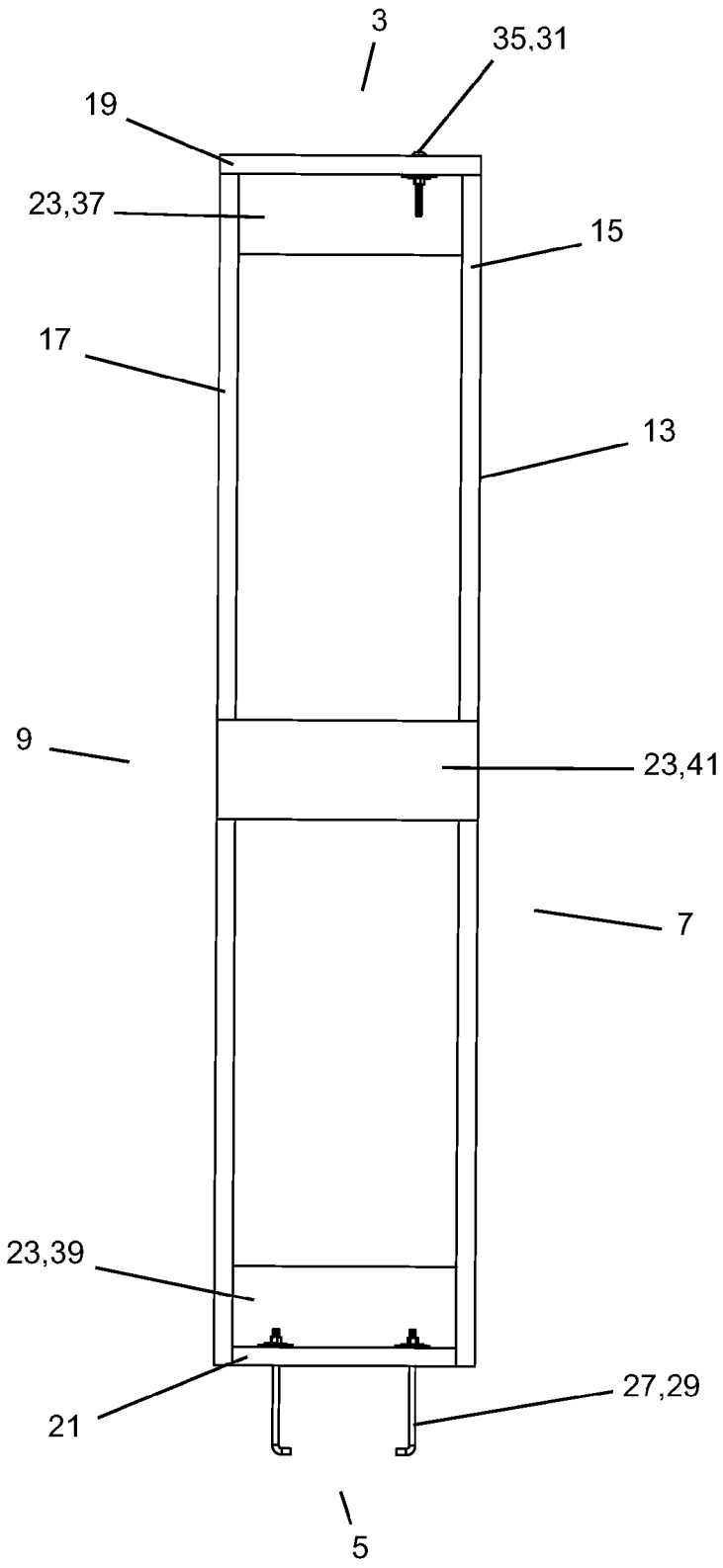
FIG. 5 is a schematic second side view of FIG. 3 with two J-bolts and a carriage bolt.

As best shown in FIG. 3, the bottom plate 21 may be provided with at least two apertures 25. As best shown in FIG. 5, a foundation bolt 27, such as J-bolt 29 or a carriage bolt 31, may be provided through each of the apertures 25 of the bottom plate 21, whereby the stud frame 1 is coupled with the foundation.

The at least two apertures 25 of the bottom plate 21 may be two apertures 25 of the bottom plate 21. Each of the apertures 25 of the bottom plate 21 may each be ½ inch in diameter. One of the apertures 25*a* of the bottom plate 21 may be 3½ inches from an outer side 7 of the bottom plate 21; and the other aperture 25*b* of the bottom plate 21 may be 3½ inches from an inner side 9 of the bottom plate 21. Further, each of the apertures 25 of the bottom plate 21 may have a center 1¾ inches from the first side 11 and the second side 13 of the stud frame 1.

The top plate 19 may be provided with at least one aperture 25. A roof bolt 35, such as a carriage bolt 31, may be provided through each of the apertures 25 of the top plate 19, whereby the stud frames 1 is coupled with the roof. Thus, for example, the top plate 19 of the stud frame 1 may be coupled with the roof via the roof bolt 35 through both the top plate 19 and a roof truss.

Figure 4:
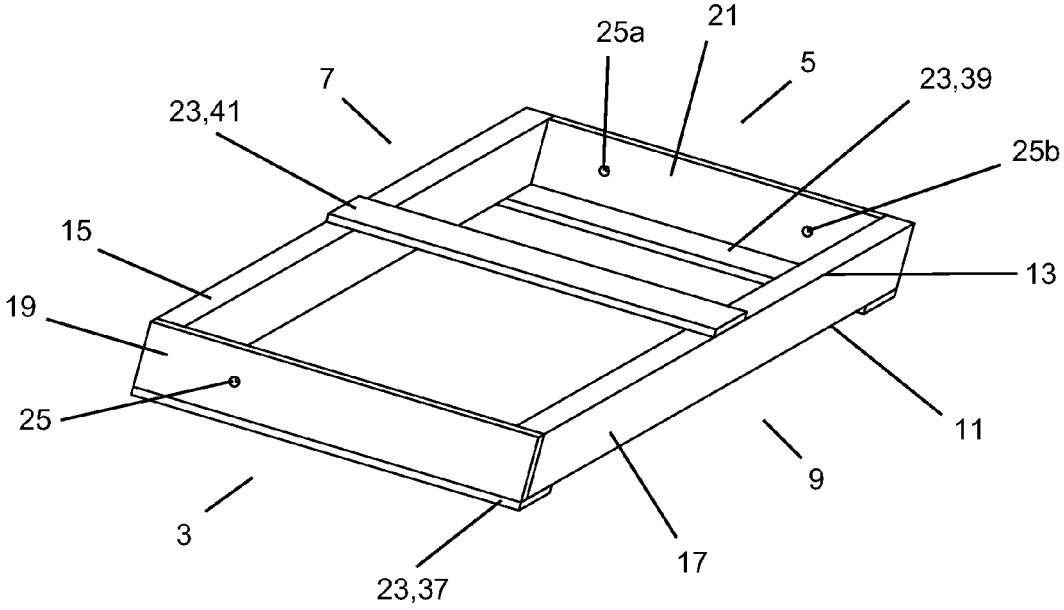
FIG. 4 is a schematic isometric angled top side view of FIG. 3.

As best shown in FIG. 4, the at least one aperture 25 of the top plate 19 may be a single aperture 25 of the top plate 19. The aperture 25 of the top plate 19 may be ½ inch in diameter. The aperture 25 of the top plate 19 may be five inches from an outer side 7 of the top plate 19. Further, the aperture 25 of the top plate 19 may have a center 1¾ inches from the first side 11 and the second side 13 of the stud frame 1.

As best shown in FIGS. 1-5, the at least one support member 23 may be, for example, a top gusset 37, a bottom gusset 39 and a center gusset 41. The top gusset 37 may be coupled with the first side 11 of the front stud 15, the first side 11 of the back stud 17, and the first side 11 of the top plate 19. The bottom gusset 39 may be coupled with the first side 11 of the front stud 15, the first side 11 of the back stud 17, and the first side 11 of the bottom plate 21. And the center gusset 41 may be coupled with the second side 13 of the front stud 15 and the second side 13 of the back stud 17. Further, the center gusset 41 may be centered along the length of the stud frame 1.

The top gusset 37 may be coupled with the front stud 15, the back stud 17 and the top plate 19 via, for example, a plurality of fasteners. Similarly, the bottom gusset 39 may be coupled with the front stud 15, the back stud 17 and the bottom plate 21 via a plurality of fasteners. And the center gusset 41 may be coupled with the front stud 15 and the back stud 17 via a plurality of fasteners. The fasteners may be, for example, screws or nails. Glue may also be used to adhere the top gusset 37, the bottom gusset 39, and the center gusset 41 with the respective parts with which they are coupled.

The top gusset 37, the bottom gusset 39, and the center gusset 41 may each be, for example, oriented strand board (OSB). OSB has the advantages of being both durable and less expensive than alternatives. Furthermore, to minimize the amount of cutting, and hence labor, involved, the top gusset 37, the bottom gusset 39, and the center gusset 41 may each be cut from standard OSB (substantially 7/16 of one inch thick) with a width of four feet and a length of eight feet.

The top gusset 37, the bottom gusset 39 and the center gusset 41 may each be, for example, substantially eight inches wide and twenty-one inches long. A standard four feet wide by eight feet long OSB board may be cut into sections to produce twenty-four gussets. The inventor has recognized that the top gusset 37, the bottom gusset 39, and the center gusset 41 may, in this manner, be fabricated at substantially less expense than the cost of purchasing premade gussets. The left-over pieces of OSB may be used, for example, as mortar boards, spacers, or corner braces.

Coupling the front stud 15, the back stud 17, the top plate 19, the bottom plate 21, the top gusset 37, the bottom gusset 39, and the center gusset 41, as described above, with the broad sides of the front stud 15 and the back stud 17 substantially parallel, produces a box structure that provides increased lateral rigidity, resistance to vertical and horizontal twisting, and load strength. The top gusset 37 and the bottom gusset 39, when coupled as described above, keep the stud frame 1 square. The center gusset 41 provides resistance, in particular, against vertical flex. Furthermore, as shown in FIGS. 1-9, the front stud 15, the back stud 17, the to plate 19, the bottom plate 21, and the at least one support member 23 may be coupled to form an open interior for allowing a continuous injection of insulation within stud frame 1. Accordingly, as shown in FIGS. 1-9, the front stud 15, the back stud 17, the to plate 19, the bottom plate 21, the top gusset 37, the bottom gusset 39, and the center gusset 41 may be coupled to form an open interior.

FIGS. 6-9 show an exemplary embodiment of a wall for sides of a building with a roof and a foundation. The wall is provided with a top side 3, a bottom side 5, an outer side 7, an inner side 9, a first side 11 and a second side 13. One skilled in the art will appreciate that the top side 3, the bottom side 5, the outer side 7, the inner side 9, the first side 11 and the second side 13 are applied herein as identifiers for respective sides of both the wall and the discrete elements of the wall to identify the same and their respective interconnecting surfaces according to their alignment. One skilled in the art will also appreciate that the first side 11 and the second side 13, while mutually exclusive, are interchangeable and imply no particular orientation, which is to say, for example, both the first side 11 and the second side 13 may be either a left side or a right side of the stud frame 1.

Figure 9:
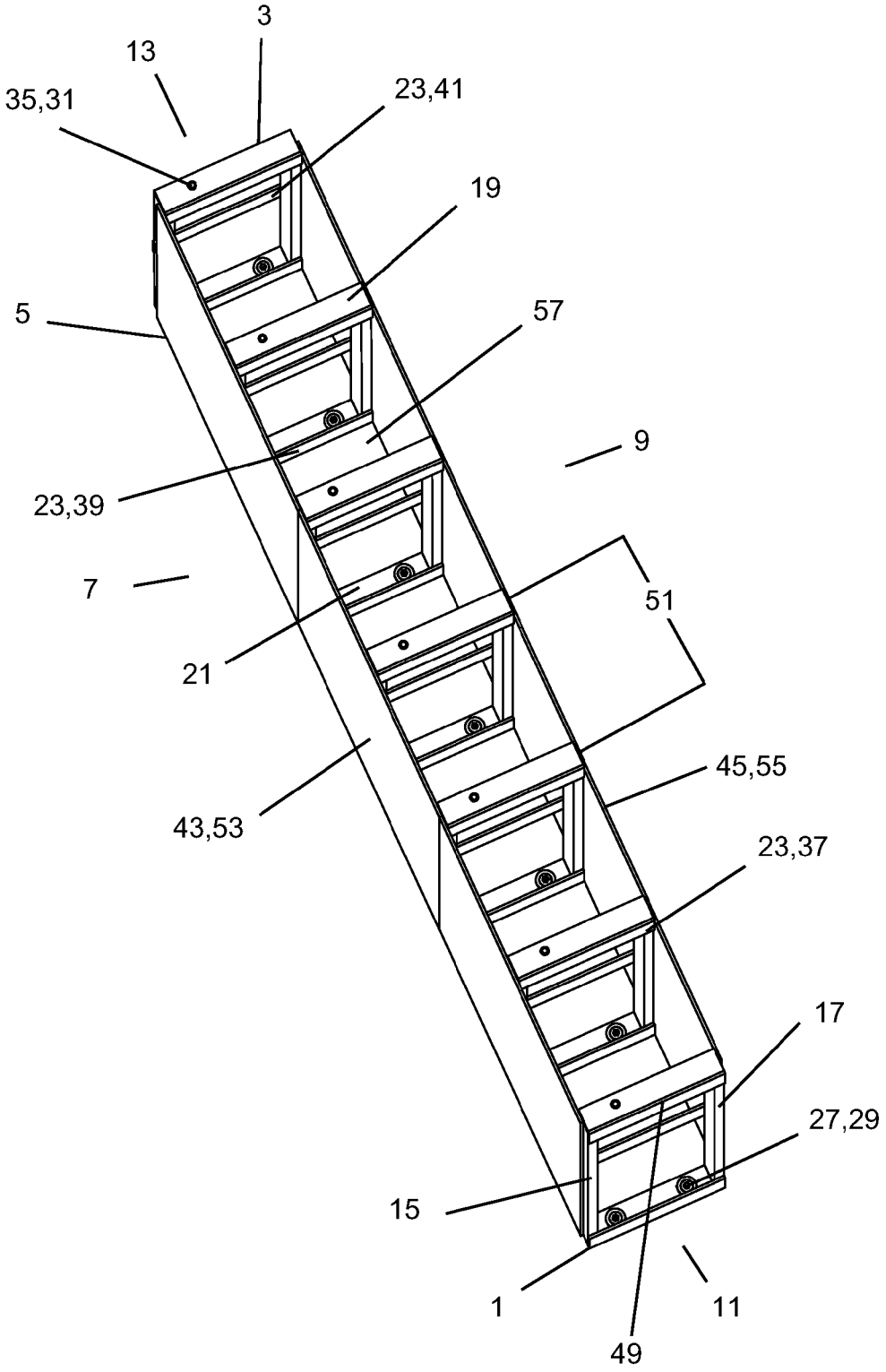
FIG. 9 is a schematic isometric angled top view FIG. 8.

The wall is provided with a plurality of stud frames 1, such as a plurality of the stud frame 1 of the exemplary embodiment of a stud frame 1 described above. As best shown in FIG. 9, the stud frames 1 may be dispose into at least one row 49. A spacing interval 51 is provided between each of the stud frames 1 of each of the at least one row 49.

As best shown in FIG. 9, the spacing interval 51 between the stud frames 1 may be, for example, substantially two feet on center. It should be noted that the spacing interval 51 between the stud frames 1 may vary to accommodate, for example, windows and doors. The spacing interval 51 between stud frames 1 may also deviate from a desired spacing interval 51 to accommodate a desired length of the wall; for example, a stud frame 1 at an end of the wall may be separated from the closest stud frame 1 in a row 49 by a spacing interval 51 greater or less than the spacing interval 51 between other stud frames 1 in the row 49.

The at least one row 49 may be multiple rows 49, each new row 49 on top of the previous row 49, for buildings with multiple levels. Accordingly, the bottom plate 21 of each of the stud frames 1 at the bottom side 5 of the wall may be coupled with the foundation via at least two foundation bolts 27; and the top plate 19 of each of stud frames 1 at the top side 3 of the wall may be coupled with the roof via at least one roof bolt 35. Where one row 49 is coupled with another row 49, the rows 49 may be coupled via, for example, a floor, with a top side 3 of the stud frames 1 of the lower row 49 coupled with a bottom side 5 of the floor, and a bottom side 5 of the stud frames 1 of the higher row 49 coupled with a top side 3 of the floor.

Figure 8:
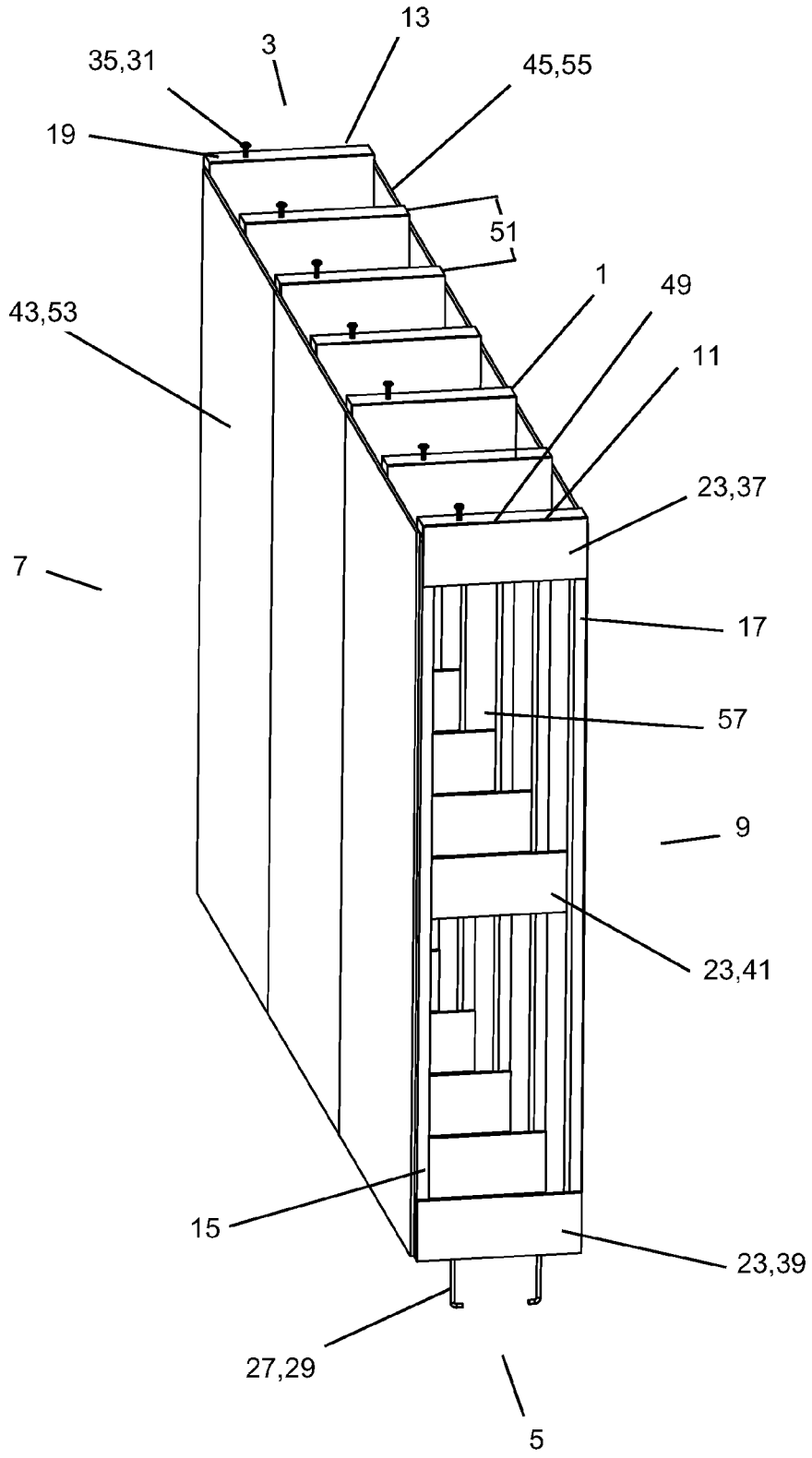
FIG. 8 is a schematic isometric angled first side view of FIG. 7 without insulation showing wall sheets of the outer layer.

The wall is provided with an outer layer 43 coupled with an outer side 7 of each of the stud frames 1 and an inner layer 45 coupled with an inner side 9 of each of the stud frames 1. As best shown in FIGS. 8-9, the outer layer 43 may comprise, for example, a layer of wall sheets 53 coupled with an outer side 7 of the front studs 15 of the stud frames 1. A layer of house wrap may be coupled with an outer side 7 of the wall sheets 53. An exterior protective layer may be coupled with an outer side 7 of the house wrap; or if no house wrap is used, the exterior protective layer may, for example, be coupled with an outer side 7 of the wall sheets 53. The wall sheets 53 may be a plurality of standard oriented strand board (OSB) sheets, for example, substantially four feet wide by eight feet long. The length of the wall sheets 53 may be substantially parallel with the length of the stud frames 1. The exterior protective layer may be, for example, siding or paint.

Figure 7:
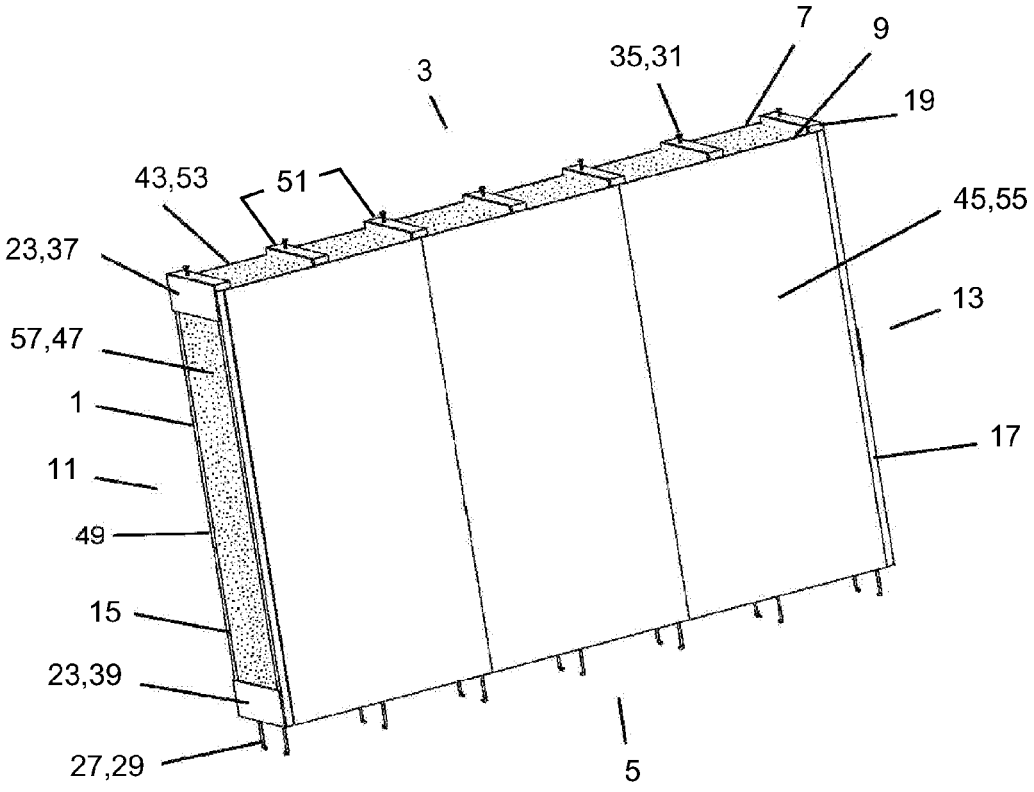
FIG. 7 is a schematic isometric angled cut-away side view of FIG. 6 showing wallboards of the inner layer.

As best shown in FIG. 7, the inner layer 45 may comprise, for example, a layer of wallboards 55 coupled with an inner side 9 of the stud frames 1. An interior decorative layer may be coupled with an inner side 9 of the wallboards 55. The wallboards 55 may be a plurality of standard OSB sheets, for example, substantially four feet wide by eight feet long. The wallboards 55 may also be standard drywall, for example, substantially four feet wide by eight feet long. The length of the wallboards 55 may be substantially parallel with the length of the stud frames 1. The interior decorative layer may be, for example, wallpaper or paint. Dimensions of the outer layer 43 and the inner layer 45 may be altered to accommodate, for example, doors, windows and desired wall length.

By utilizing boards and other components of standard lengths and dimensions, and avoiding resizing boards and components whenever possible, the amount of time involved in construction, and hence labor cost, may be reduced. Waste is also thereby reduced. For example, by utilizing, for the front stud 15 and the back stud 17, boards having a standard nominal length of eight feet, the stud frame 1 may be constructed so as to be compatible with standard sized wallboards 55, such as sheets of oriented strand board (OSB) or drywall, substantially 4 feet wide by 8 feet long, without the need to alter the length of the wallboards 55. Further, by using a spacing interval 51 of two feet on center between stud frames 1 of each of the rows 49 of stud frames 1, each of the wallboards 55 may be coupled with the outer side 7 of three of the stud frames 1; and each of the wall sheets 53 may be coupled with the inner side 9 of three of the stud frames 1.

Figure 6:
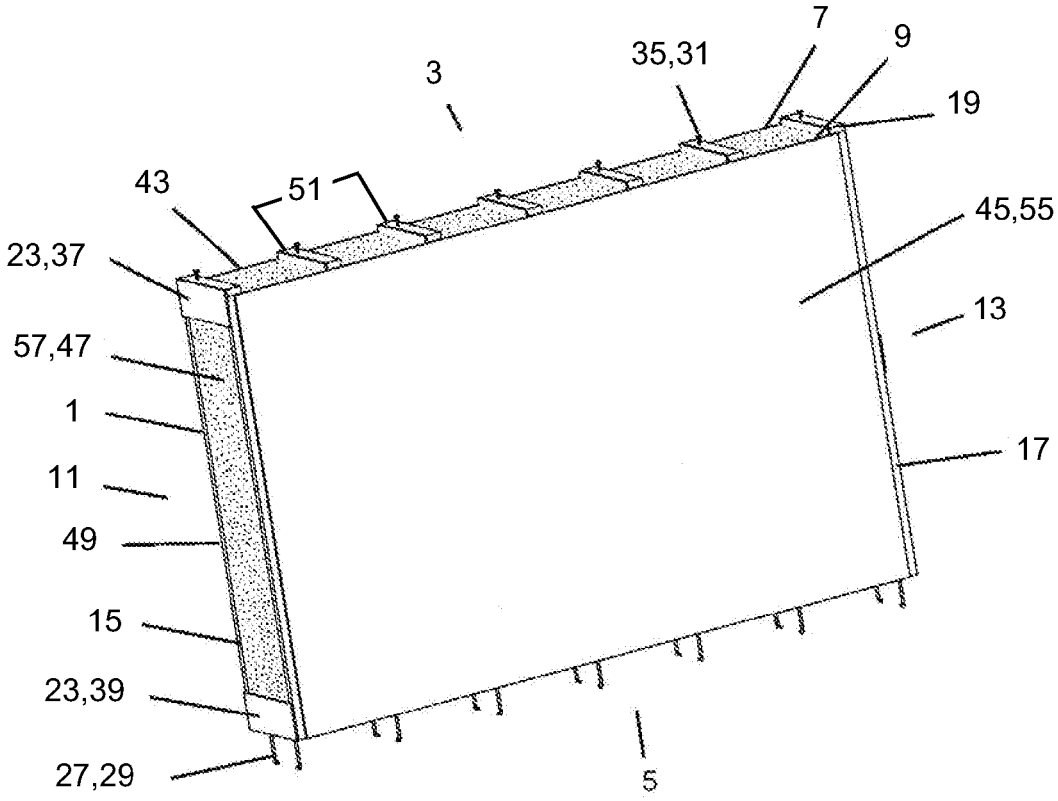
FIG. 6 is a schematic isometric angled inner side view of an exemplary wall provided with a plurality of the stud frame of FIG. 5.

As shown in FIGS. 6-7, the wall may be provided with an insulation layer 47 between the outer layer 43 and the inner layer 45. The row 49 of stud frames 1 provides an open wall interior 57, allowing the insulation layer 47 to be injected continuously, without the framing acting as a barrier, thus eliminating "thermal bridging." The insulation layer 47 may be, for example, treated cellulose or fiberglass. The inventor has calculated that the wall interior 57, between the outer layer 43 and the inner layer 45, with a thickness twenty-one inches provides a thermal resistance value (R-value) for the wall of R-65 (when treated cellulose is used as the insulation layer 47). A thickness of twenty-one inches for wall interior 57 also has the advantage of providing space for working with fixtures hidden within the wall, such as electrical wires and plumbing.

The stud frames 1 may be prefabricated to facilitate easier on-site construction. Fabrication may be achieved, for example, via a jig. Making the broad sides of the front stud 15 parallel with the broad sides of the back stud 17, as opposed to parallel narrow sides, provides greater strength and stability for the stud frame 1, and more particularly, substantially increased lateral rigidity and load strength. The increased strength and rigidity of prefabricated stud frames 1 is particularly advantageous during construction, before both an outer layer 43 and an inner layer 45 have been completely coupled with the at least one row of stud frames 1 to produce a wall. Further, by orienting the front stud 15 and the back stud 17 so that the outer side 7 and inner side 9 are broad sides, an increased surface area is provided for attaching the outer layer 43 and the inner layer 45. The increased surface area makes it less difficult to couple the stud frames 1 with the outer layer 43 and the inner layer 45 via, for example, nails or screws, as it is easier not to miss the front stud 15 and the back stud 17.

By orienting the bottom plate 21 so that the top side 3 and the bottom side 5 are broad sides, and by having the bottom plate 21 flush with the bottom side 5 of the front stud 15 and the back stud 17, an increased surface area is provided for attaching prefabricated stud frames 1 with the foundation, thus increasing the stability of the stud frames 1 while the stud frames 1 are coupled with the foundation. The increased stability, in turn, provides for easier installation, allowing fewer individuals to be involved in coupling the stud frames 1 (and hence a wall) with the foundation.

Installation of prefabricated stud frames 1 is made even easier by use of the foundation bolts 27, which allow the stud frames 1 to be quickly coupled with the foundation of a building. Importantly, the foundation bolts 27 provide right angle alignment of the stud frame 1 with the foundation. By making installation easier, foundation bolts further contribute to making wall construction by fewer individuals possible. Further, coupling the bottom plates 21 at a bottom side 5 of the wall with the foundation via at least two foundation bolts 27 results in at least two rows of foundation bolts 27, thus preventing twisting of the stud frames 1 with respect to the foundation. Coupling stud frames 1 with the foundation via foundation bolts 27, as opposed, for example, to sill plates, also provides increased strength against external lateral and vertical forces.

The at least one roof bolt 35, like the foundation bolts 27, provide the advantage of efficient and cost effective on-site building installation for prefabricated stud frames 1, allowing for the stud frames 1 to be quickly coupled with the roof of a building. The roof bolts 35 also provide the advantage of superior alignment (true flush alignment). The improved alignment provided by the roof bolts 35, in combination with the improved alignment provided by the foundation bolts 27, makes it possible for construction to be achieved with fewer involved individuals. Further, coupling the stud frames 1 with the roof via the roof bolts 35, as opposed to, for example, nails or screws, provides increased strength against, for example, vertical lift forces, vertical snow loads and lateral winds.

Table of Parts

| | |
|---|---|
| 1 | stud frame |
| 3 | top side |
| 5 | bottom side |
| 7 | outer side |
| 9 | inner side |
| 11 | first side |
| 13 | second side |

-continued

| Table of Parts | |
|---|---|
| 15 | front stud |
| 17 | back stud |
| 19 | top plate |
| 21 | bottom plate |
| 23 | support member |
| 25 | aperture |
| 27 | foundation bolt |
| 29 | J-bolt |
| 31 | carriage bolt |
| 35 | roof bolt |
| 37 | top gusset |
| 39 | bottom gusset |
| 41 | center gusset |
| 43 | outer layer |
| 45 | inner layer |
| 47 | insulation layer |
| 49 | row |
| 51 | spacing interval |
| 53 | wall sheets |
| 55 | wallboards |
| 57 | wall interior |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A row of stud frames with a top side, a bottom side, an outer side, an inner side, a first side and a second side for walls of a building with a roof and a foundation, the row of stud frames comprising:

a plurality of stud frames;

the stud frames disposed vertically into at least one row;

each of the stud frames comprising:

a front stud, a back stud, a top plate and a bottom plate;

at least one support member coupled with the front stud and the back stud, such that the front stud, the back stud, the to plate, the bottom plate, and the at least one support member form an open interior;

the front stud and the back stud substantially equal in length and width;

an outer side and an inner side of the front stud and the back stud wider than a first side and a second side of the front stud and the back stud;

the outer side and the inner side of the front stud parallel with the outer side and the inner side of the back stud;

the top plate and the bottom plate disposed horizontally;

a top side and a bottom side of the top plate and the bottom plate wider than a first side and a second side of the top plate and the bottom plate;

the top side and the bottom side of the top plate parallel with the top side and the bottom side of the bottom plate;

the bottom side of the top plate attached on top of the front stud and the back stud;

the bottom plate coupled between the front stud and the back stud; and the bottom side of the bottom plate flush with a bottom side of the front stud and a bottom side of the back stud.

2. The stud frame of claim 1, wherein the top plate and the bottom plate are substantially equal in width to the front stud and the back stud.

3. The stud frame of claim 1, wherein an outer side of the top plate is flush with the outer side of the front stud; and an inner side of the top plate flush with the inner side of the back stud.

4. The stud frame of claim 1, wherein the top plate is substantially twenty-one inches long; and the bottom plate is substantially eighteen inches long.

5. The stud frame of claim 1, wherein the bottom plate is provided with at least two apertures; and a foundation bolt through each of the apertures of the bottom plate, whereby the stud frame is coupled with the foundation.

6. The stud frame of claim 5, wherein the foundation bolt is a J-bolt.

7. The stud frame of claim 1, wherein the top plate is provided with at least one aperture; and a roof bolt through each of the apertures of the top plate, whereby the stud frame is coupled with the roof.

8. The stud frame of claim 1, wherein the at least one support member is a top gusset, a bottom gusset and a center gusset;

the top gusset coupled with the first side of the front stud, the first side of the back stud and the first side of the top plate;

the bottom gusset coupled with the first side of the front stud, the first side of the back stud and the first side of the bottom plate; and the center gusset coupled with the second side of the front stud and the second side of the back stud.

9. The stud frame of claim 8, wherein the top gusset, the center gusset and the bottom gusset are each substantially eight inches wide and twenty-one inches long.

10. A superinsulated wall with a top side, a bottom side, an outer side, an inner side, a first side and a second side for a building with a roof and a foundation, the superinsulated wall comprising:

an outer layer and an inner layer;

an insulation layer provided between the outer layer and the inner layer;

a plurality of stud frames;

the stud frames provided with a front stud, a back stud, a top plate and a bottom plate;

the stud frames provided with at least one support member coupled with the front stud and the back stud, such that the front stud, the back stud, the to plate, the bottom plate, and the at least one support member form an open interior;

the stud frames disposed into at least one row;

a spacing interval between each of the stud frames of each of the at least one row;

the outer layer coupled with an outer side of each of the stud frames;

the inner layer coupled with an inner side of each of the stud frames;

the front stud and the back stud substantially equal in length and width;

the top plate and the bottom plate substantially equal in width to the front stud and the back stud;

the front stud and the back stud disposed vertically;

an outer side and an inner side of the front stud and the back stud wider than a first side and a second side of the front stud and the back stud;

the outer side and the inner side of the front stud parallel with the outer side and the inner side of the back stud;

the top plate and the bottom plate disposed horizontally;

a top side and a bottom side of the top plate and the bottom plate wider than a first side and a second side of the top plate and the bottom plate;

the top side and the bottom side of the top plate parallel with the top side and the bottom side of the bottom plate;

the bottom side of the top plate attached on top of the front stud and the back stud;

the bottom plate coupled between the front stud and the back stud;

an outer side of the top plate flush with the outer side of the front stud;

an inner side of the top plate flush with the inner side of the back stud; and the bottom side of the bottom plate flush with a bottom side of the front stud and a bottom side of the back stud.

11. The wall of claim 10, wherein the at least one support member is a top gusset, a bottom gusset and a center gusset;

the top gusset coupled with the first side of the front stud, the first side of the back stud and the first side of the top plate;

the bottom gusset coupled with the first side of the front stud, the first side of the back stud and the first side of the bottom plate; and the center gusset coupled with the second side of the front stud and the second side of the back stud.

12. The wall of claim 10, wherein each of the bottom plates at the bottom side of the wall is provided with at least one aperture; and a foundation bolt through each of the apertures of each of the bottom plates at the bottom side of the wall, whereby the wall is coupled with the foundation.

13. The wall of claim 10, wherein each of the top members at the top side of the wall is provided with at least one aperture; and a roof bolt through each of the apertures of each of the top plates at the top side of the wall, whereby the wall is coupled with the roof.

14. The wall of claim 10 wherein the outer layer comprises a layer of wall sheets and the inner layer comprises a layer of wallboards;

the wall sheets coupled with an outer side of each of the stud frames; and the wallboards coupled with an inner side of each of the stud frames.

15. A method of constructing a superinsulated wall with a top side, a bottom side, an outer side, an inner side, a first side and a second side for a building with a roof and a foundation, the method comprising:

constructing a plurality of stud frames, each of the stud frames constructed by:

providing a front stud and a back stud substantially equal in length and width, an outer side and an inner side of the front stud and the back stud wider than a first side and a second side of the front stud and the back stud;

providing a top plate and a bottom plate, a top side and a bottom side of the top plate and the bottom plate wider than a first side and a second side of the top plate and the bottom plate;

attaching a bottom plate between the front stud and the back stud, the bottom side of the bottom plate flush with a bottom side of the front stud and a bottom side of the back stud, whereby the outer side and the inner side of the front stud and the back stud are parallel;

attaching a top plate on top of the front stud and the back stud, an outer side of the top plate flush with the outer side of the front stud and an inner side of the top plate flush with the inner side of the back stud, whereby the top side and the bottom side of the top plate and the bottom plate are parallel;

attaching at least one support member to the front stud and the back stud, such that the front stud, the back stud, the top plate, the bottom plate, and the at least one support member form an open interior within each of the stud frames;

disposing the stud frames into at least one row of stud frames;

coupling an outer layer of the superinsulated wall with an outer side of each of the stud frames; and coupling an inner layer of the superinsulated wall with an inner side of each of the stud frames.

16. The method of claim 15, wherein the at least one support member is a top gusset, a bottom gusset and a center gusset.

17. The method of claim 16, further including the steps of attaching the top gusset with the first side of the front stud, the first side of the back stud and the first side of the top plate;

attaching the bottom gusset with the first side of the front stud, the first side of the back stud and the first side of the bottom plate; and attaching the center gusset with the second side of the front stud and the second side of the back stud.

18. The method of claim 15, further including the step of providing each of the bottom plates with at least two apertures.

19. The method of claim 18, wherein disposing the stud frames into at least one row of stud frames comprises attaching each of the stud frames to the foundation via a foundation bolt through each of the apertures of the bottom plates.

20. The method of claim 15, further including the step of providing each of the top members at the top side of the wall with at least one aperture for coupling of each of the top plates with the roof.

* * * * *